United States Patent [19]

Gabarro

[11] 4,060,853

[45] Dec. 6, 1977

[54] GARMENT

[76] Inventor: Horacio Carlos Gabarro, 11 de Setiembre St., No. 285, Ramos Mejia, Buenos Aires, Argentina

[21] Appl. No.: 719,999

[22] Filed: Sept. 2, 1976

[30] Foreign Application Priority Data

Sept. 5, 1975 Argentina ..... 260282

[51] Int. Cl.[2] ..... A41D 1/04

[52] U.S. Cl. ..... 2/108

[58] Field of Search ..... 2/108, 93, 85; 150/1.9; 190/1

[56] References Cited

U.S. PATENT DOCUMENTS

| | | | |
|---|---|---|---|
| 3,085,254 | 4/1963 | Cutler | 2/247 |
| 3,830,348 | 8/1974 | Ohyama | 150/1.7 |

FOREIGN PATENT DOCUMENTS

| | | | |
|---|---|---|---|
| 815,934 | 10/1951 | Germany | 2/85 |

*Primary Examiner*—Werner H. Schroeder

*Assistant Examiner*—Doris L. Troutman

[57] ABSTRACT

A garment such as a jacket or coat, having two large pockets of substantially equal size, located on opposite sides of the vertical center line of the front face of the garment. The pockets are of sufficient size that the rest of the garment, other than the pockets, can be folded to occupy an area not larger than the area of one pocket, and then the two pockets can be swung around to a position parallel to each other, encompassing the folded remainder of the garment between them. Fastening means such as a slide fastener connects the peripheries of the two pockets to each other with the folded remainder of the garment between them, to form a convenient wallet-like package for transporting the garment when it is not being worn, the pocket portions of the garment now constituting the outer faces of the wallet and still being accessible for use as pockets to hold other articles. The side edges of the pockets are of pleated or bellows formation, thus being expansible for holding other articles when the garment is folded to the wallet form as well as when it is being worn.

5 Claims, 8 Drawing Figures

FIG.2
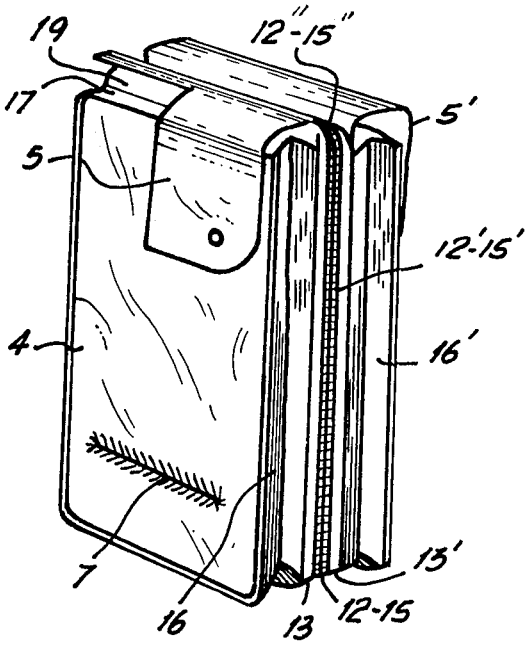
FIG.3
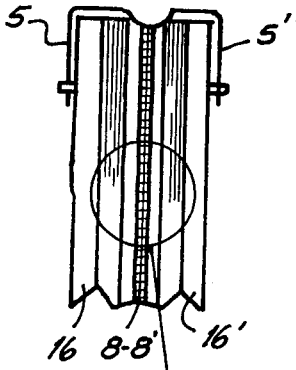
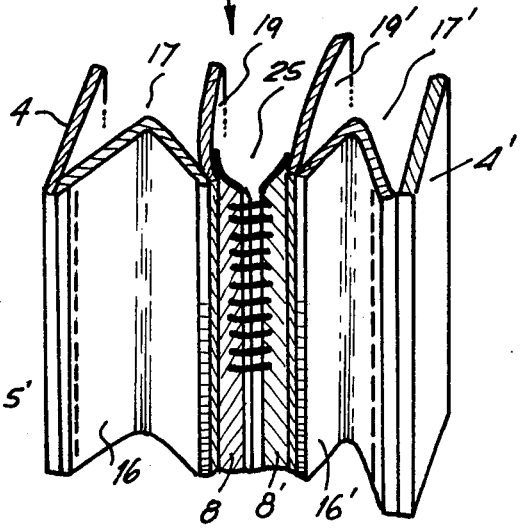
FIG.5
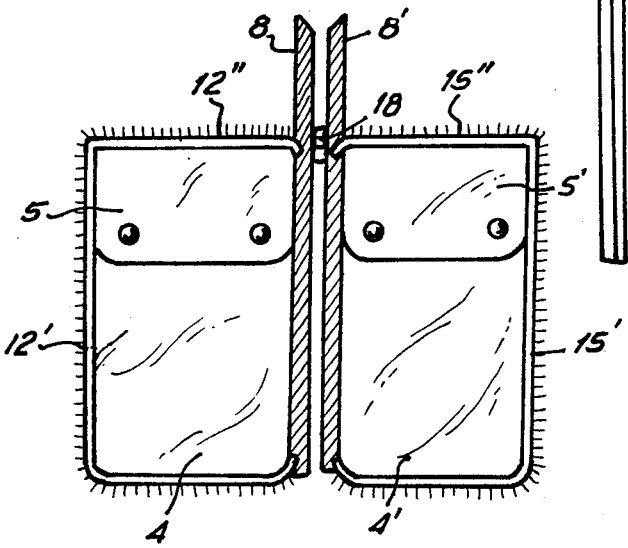
FIG.4

GARMENT

BACKGROUND OF THE INVENTION

The invention relates to improvements in garments such as trousers, field jackets, coats, raincoats, sports shirts, etc., all preferably of the sporting garment type. Such garments in general are well known, and sport garments or informal garments are of increasing popularity. It is known to use wallets or clutch bags for carrying a sport garment when it is not being actually worn, but then when a person decides to put the garment on (such as a jacket or a raincoat over other clothing) it is necessary to continue to carry the empty wallet or clutch bag until the garment is taken off and put back into the carrying container. This is frequently inconvenient and occupies one of the hands of the person.

An object of the present invention, therefore, is to provide a garment which forms its own carrying case or wallet for conveniently carrying the garment when it is not being worn, eliminating the need for carrying an empty wallet or carrying case while the garment is being worn.

Another object is the provision of such a garment having pockets which can be used for carrying other articles, so formed that the pockets are accessible for easy introduction or removal of other articles while the garment is in the folded or wallet condition, as well as when the garment is being worn.

SUMMARY OF THE INVENTION

Two relatively large pockets are provided on the front of the garment, arranged on opposite sides of and relatively close to the vertical center line of the front face or wall of the garment. Preferably the pockets are expansible in the direction of the thickness thereof, the side edges of the pockets being of pleated or bellows construction. The two pockets are of substantially equal size, and are provided with detachable fastening means (such as a slide fastener) around at least the top and bottom edges and the lateral side edges remote from each other, so that when the remainder of the garment is folded into a compact package with a relatively small area (not larger than the face area of one pocket) the two pockets may be swung back against opposite sides of the mass of folded material of the garment, and the two pockets may be fastened to each other by the slide fastener or other fastening means extending around their peripheries, encompassing or enclosing the rest of the folded garment between them. This forms a compact carrying case or wallet for the garment. The front faces of the pockets form the outer faces of the wallet or carrying structure, and thus are still accessible for insertion of articles into the pockets and removal of articles therefrom while the garment is in the folded or wallet condition, as well as when it is being worn. The pleated or bellows nature of the side edges of the pockets enables them to expand to accommodate articles placed therein, notwithstanding that the rear walls of the pockets, attached to each other by the fastening means, may be rather tightly stretched over the intervening folded layers of the material of the garment.

BRIEF DESCRIPTION OF THE DRAWINGS

FIG. 2 is a perspective view of the garment in folded condition to form its own carrying case or wallet;

FIG. 3 is an edge view of the wallet, viewed from the opposite side from that shown in FIG. 2;

FIG. 4 is a front view showing a detail of the construction illustrated in FIG. 1;

FIG. 5 is a perspective view, with parts broken away and parts in section, of the pockets folded to form the wallet, illustrating the space available for receiving the folded remainder of the garment, the structure being viewed from the same side as that shown in FIG. 3;

DESCRIPTION OF THE PREFERRED EMBODIMENT

Figure 1:
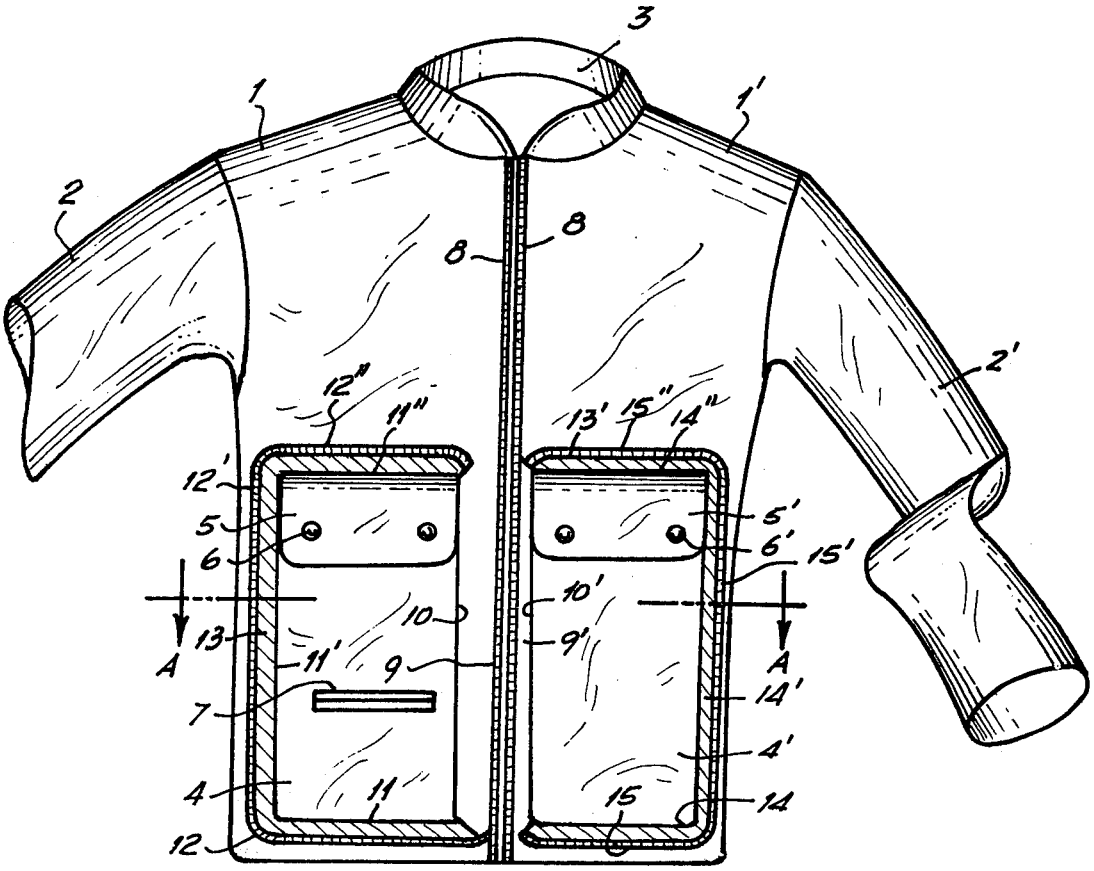
FIG. 1 is a front elevational view of a typical garment in accordance with a preferred embodiment of the invention, in its unfolded condition, ready to be worn.
Figure 6:
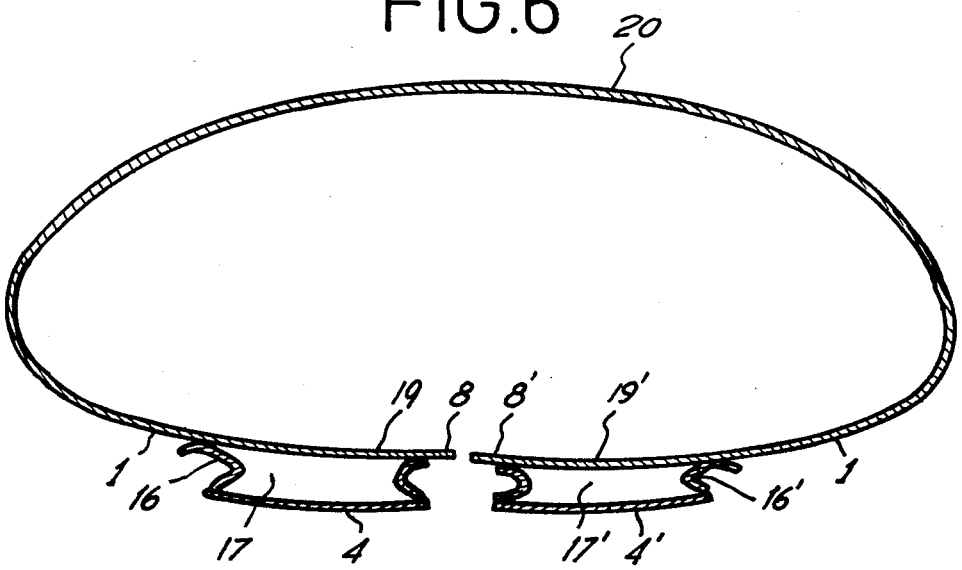
FIG. 6 is a horizontal section through the garment in unfolded condition, taken substantially on the line A—A' of FIG. 1.
Figure 7:
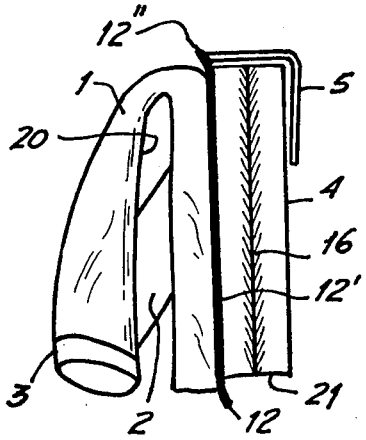
FIG. 7 is a view illustrating one phase of folding the garment to form the wallet or carrying case.

Referring first to FIG. 1, there is here shown a garment of the type often called a field jacket. This is shown merely as a convenient example to illustrate the invention, it being understood that the invention is not limited to any particular type of jacket or other garment, or any particular material from which it is made. The example illustrated in FIG. 1 (and also FIGS. 2–7) is preferably but not necessarily made of leather.

It has a right hand front section or panel 1 (right hand when worn, but left hand side when viewed from the front as in FIG. 1) and a left front panel 1', and sleeves 2 and 2' respectively, and a collar 3. Two pockets are provided on the front sections or panels of the garment, the respective pockets having respective front walls 4 and 4', and preferably also closure flaps 5 and 5' at the tops of the pockets, which closure flaps can be kept in closed position by conventional buttons or by conventional snap fasteners 6. Additional openings 7 may be provided in the front wall of one or both pockets for inserting or removing small articles without having to open the closure flap 5.

This particular garment illustrated as an example opens at the front, the right and left front panels being detachably connected to each other at their meeting edges by means of a conventional fastener having cooperating parts indicated schematically at 8 and 8' respectively. Preferably this is a conventional slide fastener or "Zipper" but other types of fasteners may be used, such as the known "Velcro" fastener consisting of a closely spaced multiplicity of small hooks on one of the two members of the fastener and a closely spaced multiplicity of small loops on the cooperating or mating part of the fastener, fastened by pushing the two cooperating parts tightly against each other, and unfastened simply by pulling them apart.

Preferably the adjacent edges 10 and 10' of the two pockets are relatively close to the line of opening of the front of the garment (that is, close to the fastening means 8 and 8') but slightly separated therefrom by narrow strips 9 and 9' of the front of the garment.

It may be noted at this point that the two pockets are of substantially equal size, and that they are aligned with each other in a vertical direction. That is, the top edges of the two pockets are at substantially the same height, and the bottom edges of the two pockets are at substantially the same height, on the same horizontal line. Preferably both pockets are of rectangular shape.

The bottom edge 11, outer side edge 11', and top edge 11'' of the pocket of the right hand half of the front wall of the garment, are provided respectively with detachable fastening means 12, 12' and 12'', respectively. This fastening means is preferably in the form of one side or track of a slide fastener or "Zipper" mounted as usual on a strip of fabric 13, this fabric 13 preferably being sewn into the seam between the pleated or bellows side walls of the pocket and the main material of the front of the garment. Similarly the other or left hand pocket (right hand when viewed from the front as in FIG. 1) has its bottom, outer side, and top edges 14, 14' and 14'', respectively, provided with the other half or track of the slide fastener, as shown at 15, 15', and 15'', respectively, attached to the mounting strip 13' attached to the seam between the pleated walls of the pocket and the jacket front panel. When the two pockets are properly brought together as further described below, the fastener track 12, 12', 12'' on one pocket will mate with the fastener track 15, 15', 15'' of the other pocket, and a conventional Zipper slider can be moved along the mating tracks, in one direction to cause them to engage and fasten to each other, and in the opposite direction to disengage them. Of course here also, just as in the case of the main front opening of the jacket, fasteners of other types could be used, such as the "Velcro" type above mentioned or even ordinary metallic hooks and eyes or any other known form of fastener could be used. However, the "Zipper" type of fastener is usually the most convenient and suitable.

If the person wearing the garment decides to take it off and carry it, he removes the garment from his body, lays it out flat, the two halves of the front of the garment being brought together and closed by operation of the fastener 8, 8'. The garment can then be picked up and the portions thereof other than the pockets can be folded into a small compact shape having an area no larger than the frontal area of the pockets. The folds can be accomplished in various ways; for example, the sleeves can first be folded to lie behind the main body of the garment, and then the main body can be folded rearwardly and downwardly approximately on a horizontal fold line at the top of the pockets, tucking in the side edges to the extent necessary, so that the entire folded garment occupies a volumetric space immediately behind and occupying no greater area than the frontal area of the two pockets. This is merely one example of the way it may be folded. Each user may have his own preferred way of folding the garment into the area behind the pockets. A partially folded garment is illustrated schematically in FIG. 7.

A final fold may then be made, folding the two pockets back to back on a fold line between the two pockets. Such a fold line coincides with the now closed fastener 8, 8', and may be described as the vertical axis of symmetry of the garment. When these pockets are folded back to back, they will then occupy approximately the relative positions shown in FIG. 5, with the back walls 19 and 19' of the two pockets separated from each other by a space 25 which contains the remainder of folded garment.

Then the peripheral fasteners going around three sides of each pocket are brought together, the two mating parts being interengaged with each other in the usual manner of such fasteners. The result is substantially what is shown in FIGS. 2 and 3, the outer walls 4 and 4' of the pockets now being the outer walls of the compact package or wallet, while the inner walls 19 and 19' of the pockets are arranged back to back and separated by several intervening layers of the material from which the garment is made, be it leather, cloth, plastic sheeting, or other material.

The inner walls 19 and 19' of the pockets are preferably formed by the main body sheeting 1 and 1', but of course it is possible to form the pockets with separate inner walls, and then fasten the entire completed pocket on the front of main body 1, 1' of the garment.

Because the peripheral fastening of the completed and closed wallet is a fastening engaging directly with the rear walls 19 and 19' of the pockets, rather than with the front walls 4 and 4', it follows that the tension or stress or pressure caused by the quantity of material in the compartment between the pocket rear walls 19 and 19' will be transmitted directly to these rear walls. Consequently these rear walls of the pockets will be rather tightly embraced around the filling of the folded garment, but there will not be such pressure on the front walls 4 and 4', because of the pleated or bellows nature of the edge walls 16 and 16' extending around the sides and bottom of each respective pocket. Therefore, although the rear walls 19 and 19' of the pockets will be quite taut when the article is in its folded or wallet form, the front walls will not be taut, and there will still be plenty of space available in the pockets, for articles placed in them either while the garment was still being worn or after it was folded in the compact wallet condition. The pockets are always available on the outside of the wallet package, for insertion or removal of articles.

Figure 8:
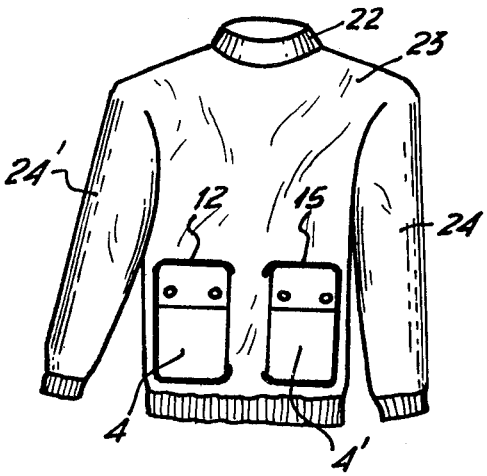
FIG. 8 is a view similar to FIG. 1, illustrating a different form of garment embodying the invention.

FIG. 8 illustrates the invention as applied to a garment which does not open at the front, but which is put on over the head of the wearer, like a pull-over sweater. The garment may have a collar portion 22, a main front body portion 23, and sleeves 24 and 24'. The pockets as before, are indicated at 4 and 4', and their respective fastener parts at 12 and 15.

Just as in the previous embodiment, the garment is folded so that the remainder of it occupies a space behind the frontal area of the pockets 4 and 4', and then these pockets are swung back to back against each other, along a fold line substantially coinciding with the vertical axis of symmetry of the garment, compressing the folds of the remainder of the garment between the rear walls of the pockets. Then the fastener parts 12 and 15 are brought into cooperative mating relation to each other, as in the previous embodiment, resulting in a compact package of wallet form which is easily carried by the owner.

The principle of the invention having now been fully explained, it will be readily apparent how it can be applied within the skill of the art to other forms or kinds of garments. No matter what kind of garment, when it is folded into the wallet or carrying form, it is but the work of a moment to disengage the fasteners extending peripherally around three sides of the pockets, and open the garment up and put it on the body of the owner. While it is not being worn, it forms a neat and attractive package, easily carried in one hand. When the garment is being worn, there is no separate carrier or wallet which needs to be carried. The pockets are available for inserting or removing articles, at all times

What is claimed is:

1. A garment comprising:

a. a main body portion having separable edges that are openable along a vertical front center line;

b. two equal-sized, bellows pockets having approximately rectangular outlines and closeable top openings for access to the interiors of said pockets;

c. said pockets being permanently attached to the exterior of said body portion of said garment and arranged to be opposite each other on opposite sides of said front center line in regions adjacent said separable edges;

d. separable fastener means extending vertically along said front center line for openably closing said separable edges along the front of said garment in the region between said pockets;

e. detachable fastening means extending around three sides of each respective pocket to extend along the top edges of each pocket, along the lateral edges of each pocket remote from said front center line, and along the bottom edges of each pocket;

f. said pockets being sized and positioned so that the remainder of said garment other than said pockets can be folded to fit within said rectangular outline of said pockets and contained between said pockets when said pockets are arranged back to back;

g. said detachable fasteners extending around three sides of said pockets being connectable to each other to fasten said pockets to each other along three respective sides of said pockets to form a partially closed wallet containing said remainder of said garment; and h. said separable fastener extending along the front center line of said garment being closeable to connect said separable edges of said garment to close said wallet by effecting a closure between the fourth sides of said pockets along said front center line.

2. A garment as defined in claim 1, wherein at least one of said pockets has a front wall and a rear wall and a bellows-like pleated edge wall connecting said front wall to said rear wall throughout part of the periphery of said pocket.

3. A garment as defined in claim 2, wherein said fastening means is so placed that any pull exerted on said fastening means is transmitted mainly to said rear wall rather than said front wall.

4. A garment as defined in claim 2, wherein said detachable fastening means comprises a slide fastener track on a mounting strip, and wherein said mounting strip is fastened to said rear wall of its associated pocket.

5. A garment as defined in claim 2, wherein said rear wall of said pocket is formed by part by said main body portion of the garment.

* * * * *